US006222320B1

(12) United States Patent
Stockwald

(10) Patent No.: US 6,222,320 B1
(45) Date of Patent: Apr. 24, 2001

(54) METAL HALIDE LAMP WITH A STARTING AID

(75) Inventor: Klaus Stockwald, Munich (DE)

(73) Assignee: Patent Truehand-Gesellschaft fuer elektrische Gluelampen mbH, Munich (DE)

( * ) Notice: Subject to any disclaimer, the term of this patent is extended or adjusted under 35 U.S.C. 154(b) by 0 days.

(21) Appl. No.: 09/487,020

(22) Filed: Jan. 19, 2000

(30) Foreign Application Priority Data

Jan. 20, 1999 (DE) ..... 199 01 987

(51) Int. Cl.[7] ..... H01J 7/44
(52) U.S. Cl. ..... 315/48; 315/56; 315/59
(58) Field of Search ..... 315/74, 73, 59, 315/58, 56, 48

(56) References Cited

U.S. PATENT DOCUMENTS 5,355,053 10/1994 Zhu ..... 315/73

FOREIGN PATENT DOCUMENTS 0722184 7/1996 (EP) .
0732870 1/1999 (EP) .

*Primary Examiner*—David Vu
(74) *Attorney, Agent, or Firm*—William H. Mc Neill

(57) ABSTRACT

In a metal halide lamp having a ceramic, tubular discharge vessel (1), there is fitted outside on the discharge vessel an electrically conducting starting aid (11) which provides an inhomogeneous electric field strength. It comprises a metal wire which extends transverse to the axis and from the frame (8) out to the outer wall of the discharge vessel. It ends there approximately at the level of an electrode (2).

10 Claims, 3 Drawing Sheets

METAL HALIDE LAMP WITH A STARTING AID

TECHNICAL FIELD

The invention proceeds from a metal halide lamp in accordance with the preamble of Claim 1. At issue here are metal halide lamps with a starting aid fitted outside the ceramic discharge vessel.

PRIOR ART

The use of starting aids which reduce the starting voltage has been known for a long time. An earlier alternative was to add a radioactive gas (Kr 85) to the starting gas in the lamp.

U.S. Pat. No. 5,355,053 has already disclosed a metal halide lamp with an external starting aid. When metal halide lamps are started, the electric flashover is produced by a high-voltage pulse which is applied between the two electrodes located in the ceramic discharge vessel. The absolute value of this high voltage is determined by the geometrical dimensions of the discharge vessel and, in particular, by the cold filling pressure of the inert gas (mostly xenon) located therein. A high cold filling pressure leads, on the one hand, to high light yields and good maintenance, but on the other hand requires correspondingly high starting voltages which are not directly available.

A remedy is found in an electrically conducting, metal starting aid fitted outside on the discharge vessel. It is either a metal wire or a strip, which is sintered onto the ceramic discharge vessel. The separate part can likewise have the shape of a starting strip which bears against the discharge vessel and is pressed on, for example, by means of a bimetal. During operation, the bimetal lifts this starting aid up off the discharge vessel. This is required, since the starting aid is electrically connected to one of the two electrodes, and so there is a steep gradient of the electric field strength present between the starting aid and the second electrode, which leads to diffusion of the sodium through the wall of the discharge vessel.

A bimetal is dispensed with in the case of starting aids lacking direct electric contact with the system voltage. Instead of this, use is made of axial or helical starting strips surrounding the discharge vessel. The starting aid is coupled in this case to the starting pulse only capacitively. Since it is at a freely floating potential, sodium diffusion is prevented. Such a design is also used for metal halide lamps, where it is fitted, in particular, on the outer bulb (EP-A 732 870). This lamp has a substantially smaller fraction of sodium in the filling.

The flashover forms in like manner in both cases, that is to say both for direct and for capacitive coupling. Firstly, a discharge is produced between the first electrode, at which the high-voltage pulse is present, and the nearest point on the ceramic wall, on which the starting aid is seated outside. Discharge propagates on the ceramic wall until there is finally a flashover to the second electrode.

In the case of starting aids lacking direct electric contact with the system voltage, because of the capacitive coupling there is set up on the starting aid a potential which is between that of the high-voltage pulse at the first electrode and the zero potential of the second electrode. The potential difference between the high-voltage pulse and the starting aid is consequently less than when the starting aid is at the potential of one of the electrodes. The level of the starting voltage is decided by the field strength forming in the space between electrode tip and starting aid. In this case, the geometry and the spacings influence the level of the starting voltage.

A further previously known solution for, metal halide lamps having a discharge vessel made from quartz glass is to provide UV emitting, gas-filled chambers outside the discharge volume (EP-A 722 184). Starting is facilitated here by the ionizing effect of UV radiation.

SUMMARY OF THE INVENTION

It is the object of the present invention to provide a metal halide lamp in accordance with the preamble of Claim 1 which starts relatively unproblematically and whose starting aid is simple and cost-effective to produce. A further object is to reduce the electric field strength required for starting, in particular for lamps with a high metal halide dose, as required principally in metal halide high-pressure lamps which are virtually or completely free from mercury, and thus to facilitate starting and arc acceptance in these lamps.

This object is achieved by means of the characterizing features of Claim 1. Particularly advantageous refinements are to be found in the dependent claims.

Metal halide lamps with little mercury (corresponding to less than 1 mg/cm$^3$ Hg), chiefly mercury-free metal halide lamps, exhibit substantial difficulties in starting reliably. In these lamps, which contain a high dose of metal halides (for example, 10 to 250 $\mu$mol/cm$^3$), there is the difficulty of metal halide layers condensing on the electrode surfaces as the lamp cools. As a result, the process of releasing electrons from the surface of the electrodes, which is decisive for multiplying the charge carriers, proceeds substantially less efficiently than in the case of an electrode surface which is uncoated or coated with metal (Hg). For example, in the case of Hg-containing lamps small Hg droplets condense on the electrode surface.

The use of a single-ended starting aid results in the formation of a capacitive auxiliary discharge which is directed away laterally from the electrode and preionizes the discharge path between the electrodes. To be precise, the auxiliary discharge emits high-energy UV radiation into the volume between the electrodes. This process is so efficient that the multiplication of the charge carriers in this volume, and thus the flashover, is strongly promoted.

According to the invention, the starting aid is constructed such that it produces a strong inhomogeneity of the electric field strength between the starting aid and the assigned electrode. As a result, the efficiency of the starting aid is substantially increased for the same value of the applied starting voltage.

The starting aid can be produced from heat-resistant metal (typically tungsten) in the case when the electrode bears permanently against the discharge vessel. If it is desired to have only a temporary contact with the discharge vessel in the cold state of the lamp, the use of a thin bimetal strip is to be recommended.

In the case of lamps having a ceramic discharge vessel, no indication has been established of sodium diffusion induced by the bearing of a metallic starter electrode, at least over a burning life of approximately 5000 h.

The design is also helpful, in particular, in ceramic metal halide lamps where addition of radioactive fractions in the starting gas, such as Kr 85, for example, is dispensed with. Furthermore, the hot starting of ceramic metal halide lamps is facilitated when the starting electrode bears permanently.

A first embodiment of the starting aid consists in creating at one end (or also at two ends) a punctiform contact of a starting aid on the outside of the wall on the discharge vessel, approximately at the level of a first electrode, advantageously in the vicinity of the electrode tip or in the bordering region of electrode shaft. In this case, the direct spacing between the starter electrode and electrode should be substantially smaller than the spacing between the two electrodes in the discharge volume.

The punctiform design creates an extremely strong inhomogeneity in the electric field strength. This punctiform starting aid (starting electrode) is connected to the lead of the other, second electrode.

The outer starting electrode can bear on the outside of the discharge vessel temporarily or else permanently. In the case of lamps capped at one end, the starting electrode is fitted (welded) on the frame which holds the discharge vessel and, proceeding from there, touches the discharge vessel in the vicinity of the first electrode, while the frame leads to the second electrode.

The fact that a starting aid bears against the ceramic discharge vessel produces a capacitive partial discharge between the starting aid and internal electrode. Because of the smaller geometrical spacing between the starting aid and the internal electrode, by comparison with the electrode spacing in the discharge vessel, the starting conditions are more favourable owing to the higher electric field strength. This relationship is described by Paschei's Law, in accordance with which the starting voltage $U_z$ is a direct function of the cold filling pressure p (of the starting gas), and the electrode spacing d, that is to say $U_z$=f (pxd).

A capacitively coupled auxiliary discharge to the wall of the discharge vessel is formed. This low-power auxiliary discharge produces an efficient preionization of the starting gas in the discharge volume, which is filled with starting gas in the form of inert gas (typically Ar, Ar/Hg mixture, Xe), with the result that the conditions for starting between the electrodes are greatly facilitated. Once an auxiliary discharge has been produced, a gas breakdown forms quickly between the electrodes.

It is to be seen that even in the case of lamps completely free of Hg and having a high fraction of metal halide (typically 10 to 250 $\mu$mol/cm$^3$), the starting electrode substantially reduces the electric field strength for starting the lamp (typically by 30%).

The embodiment with a permanently bearing starting electrode can also be applied in the case of ceramic metal halide lamps with sodium as a filling constituent, without sodium diffusion occurring through the wall of the discharge vessel.

Where there is a risk of increased sodium diffusion, for example in the case also of discharge vessels made from quartz glass, the electrode can be designed as a thin bimetallic strip which lifts up off the discharge vessel upon being heated during operation. The design is also particularly helpful in the case of lamps in which an addition of radioactive fractions in the buffer gas (Kr 85) is dispensed with. Moreover, a permanently bearing starter electrode also facilitates the hot restarting of ceramic metal halide lamps.

A second embodiment uses a flat, strip-shaped starting aid for a bellied discharge vessel. It is coupled purely capacitively without connection to a lead for an electrode. In this embodiment, the starting aid is arcuately curved by virtue of the fact that the starting strip is fitted in an axially parallel fashion on the discharge vessel, specifically in the region which is bellied (elliptically or in the shape of a barrel, etc). It is advantageous for a thin (for example printed) conductor track (for example an Mo/W-$Al_2O_3$-Cermet layer) to be applied to the outer skin of the bellied ceramic discharge vessel in such a way that, upon the application of a starting voltage pulse, capacitively coupled auxiliary discharges are formed from both lamp electrodes towards the wall of the discharge vessel, a preionizing auxiliary discharge thereby being produced. The arcuate curvature also leads here to an inhomogeneity in the electric field, and thus to easier starting.

The width of the starting strip (in the from of a printed conductor track) is selected in this case to be as narrow as possible, typically with a width of 0.1 mm. The length is dimensioned such that the starting conditions between each electrode and the starting strip on the outer wall of the discharge vessel are more favourable than between the electrodes. This means that the position and length of the starting strip are selected such that the sum of the two spacings between in each case an inner electrode and the starting strip is smaller than the electrode spacing inside.

An advantage of this arrangement is that in this case there is no need for an additional external structure on the frame. Furthermore, there is no permanent contact between the starting strip and electrode, with the result that the risk of possible diffusion processes through the wall of the discharge vessel is very low. This is important in the case of sodium-containing filling.

The starting aid according to the invention can be produced simply and cost-effectively. For example, the starting strip can be produced by a screen printing method, dispenser printing method or stamp printing method.

It is advantageous to use as the material of the discharge vessel aluminium oxide which is free from admixtures of yttrium oxide and zirconium oxide. In the case of a sodium high-pressure lamp, these substances prevent the diffusion of the sodium. However, they render production more expensive and complicated. By contrast, an admixture of MgO or the like is desirable. In general, its fraction should be below 500 ppm.

FIGURES

The aim below is to explain the invention in more detail with the aid of a plurality of exemplary embodiments. In the drawing:

FIG. 1 shows a metal halide lamp with a starting aid in a sectional side view;

FIG. 2 shows a further exemplary embodiment of a metal halide lamp; and

FIG. 3 shows a third exemplary embodiment of a metal halide lamp.

DESCRIPTION OF THE DRAWINGS

A metal halide lamp sealed at one end is shown in FIG. 1. Its discharge vessel 1, which is sealed at both ends and defines a longitudinal axis, is tubular with a constant diameter and consists of aluminium oxide ceramic with 400 ppm MgO. The discharge vessel 1 can, however, also be bellied. Two electrodes 2, 3 are axially inserted into the discharge volume by means of lead-throughs 7, 9 at the ends of the discharge vessel. The discharge vessel 1 is surrounded by an outer bulb 4 capped at one end. The outer bulb 4 is sealed by a pinch 5 in which two molybdenum foils 10 are sealed in a vacuum-tight fashion. A first short supply lead 6 connects the lead-through 7 at the first end of the discharge vessel to the first foil 10. A second supply lead, which is constructed as a solid frame 8, leads from the second foil 10 along the inner wall of the outer bulb 4 to the second lead-through 9. The filling consists of xenon at a cold filling pressure of 150 mbar, as well as the halides of the metals sodium, thallium, indium, hafnium and one or more lanthanides. The total quantity of metal halides is approximately 30 mg/cm$^3$ and corresponds approximately to 130 $\mu$mol/cm$^3$. Mercury is not used.

Fitted outside on the discharge vessel 1 at the level of the first electrode 2 is a starting electrode 11. It is a wire with a diameter of 0.2 mm, which extends from the frame 8 transverse to the lamp axis up to the outer wall of the discharge vessel 1. The starting electrode is welded on the frame 8 and consists either of a thin tungsten wire or a bimetallic strip. The starting electrode 11 is advantageously offset rearwards from the head of the electrode 2 by approximately 0.5 to 1 mm. This is to be recommended, in particular, for bellied or elliptic discharge vessels, since the spacing in relation to the electrode shaft can then be kept smaller. Also illustrated in FIG. 1 is the likely path of the discharge for the preionizing auxiliary discharge 12. It extends directly from the electrode 2 to the starting electrode 11.

Figure 1:
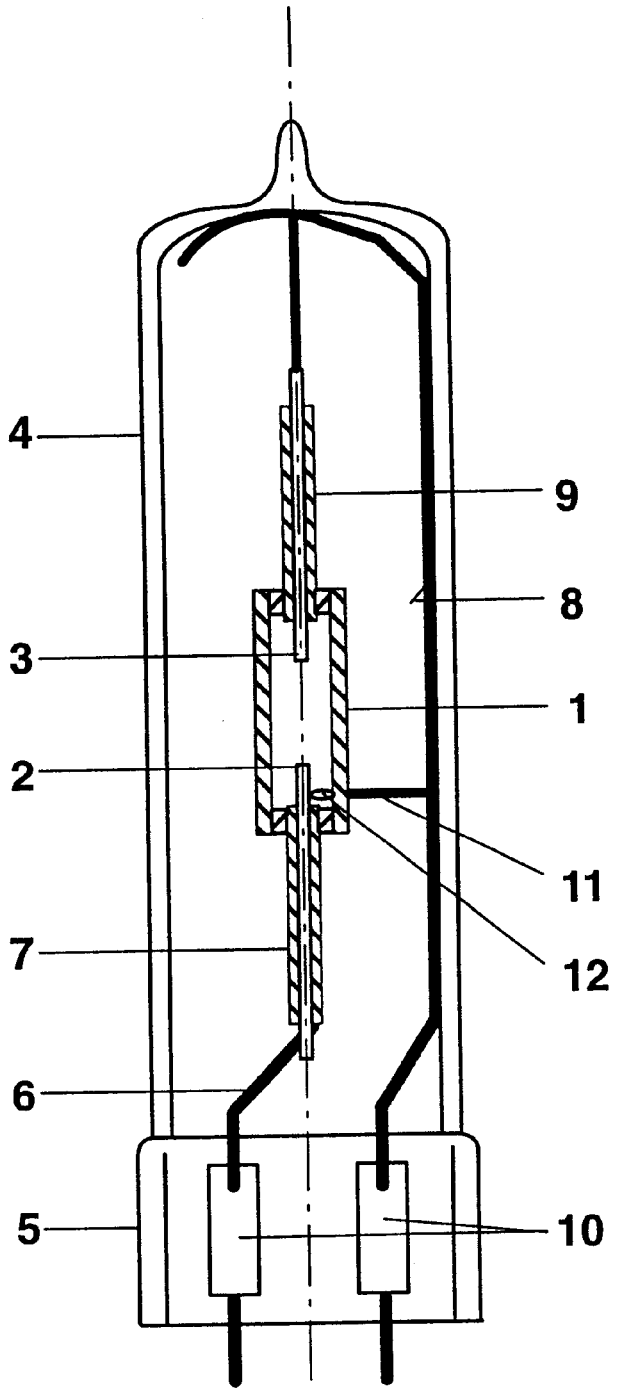
Figure 2:
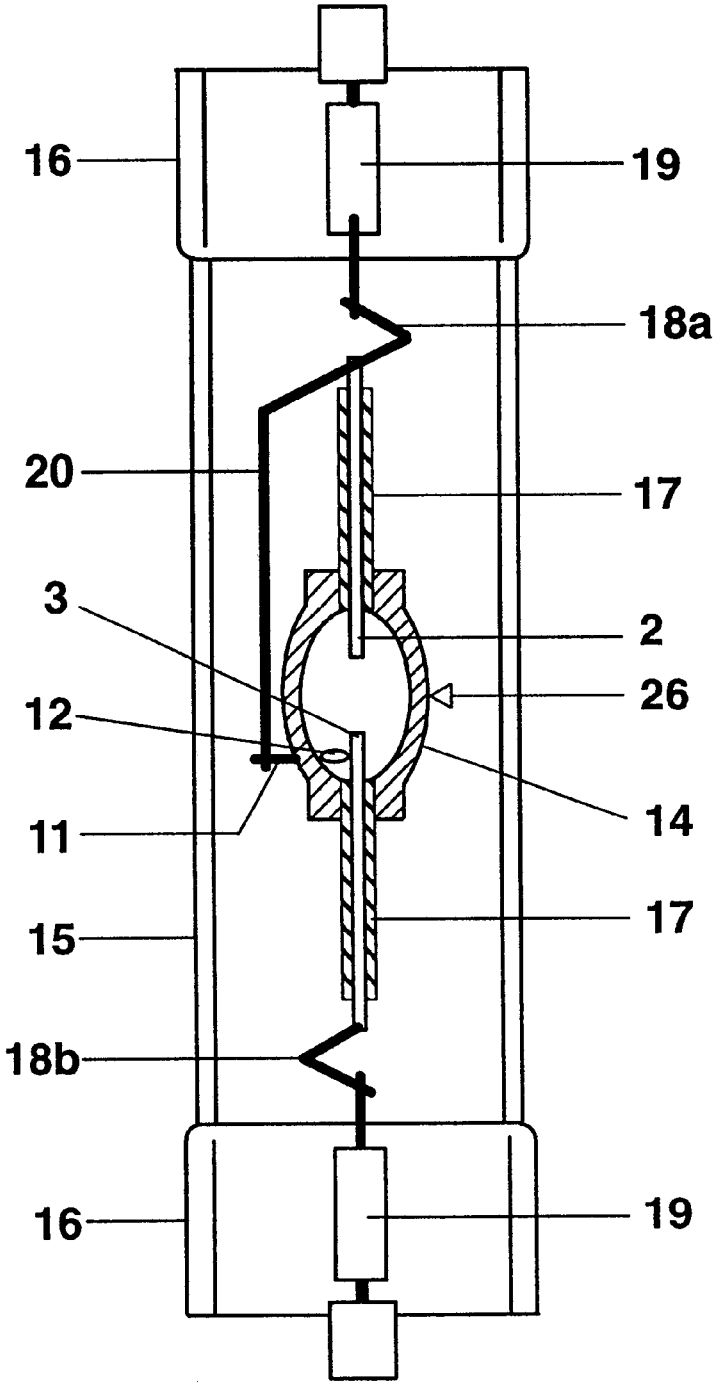

A metal halide lamp capped at two ends is shown in FIG. 2. The discharge vessel 14 corresponds largely to the exemplary embodiment represented in FIG. 1. However, the discharge vessel is elliptically bellied (26) in the middle, tubular end parts being mounted on the discharge volume. The outer bulb 15 is sealed at two ends by pinches 16. Each lead-through 17 is connected directly to the molybdenum foil 19 in the pinch 16 via a short supply lead 18*a*, 18*b* in the form of an expansion loop. In addition, the first supply lead 18*a*, which leads to the first electrode 2, is lengthened by an angular rod 20 up to the level of the second electrode 3, where a starting electrode 11 is attached at right angles to the bar 20 and is guided transverse to the lamp axis up to the outer wall of the discharge vessel.

Figure 3:
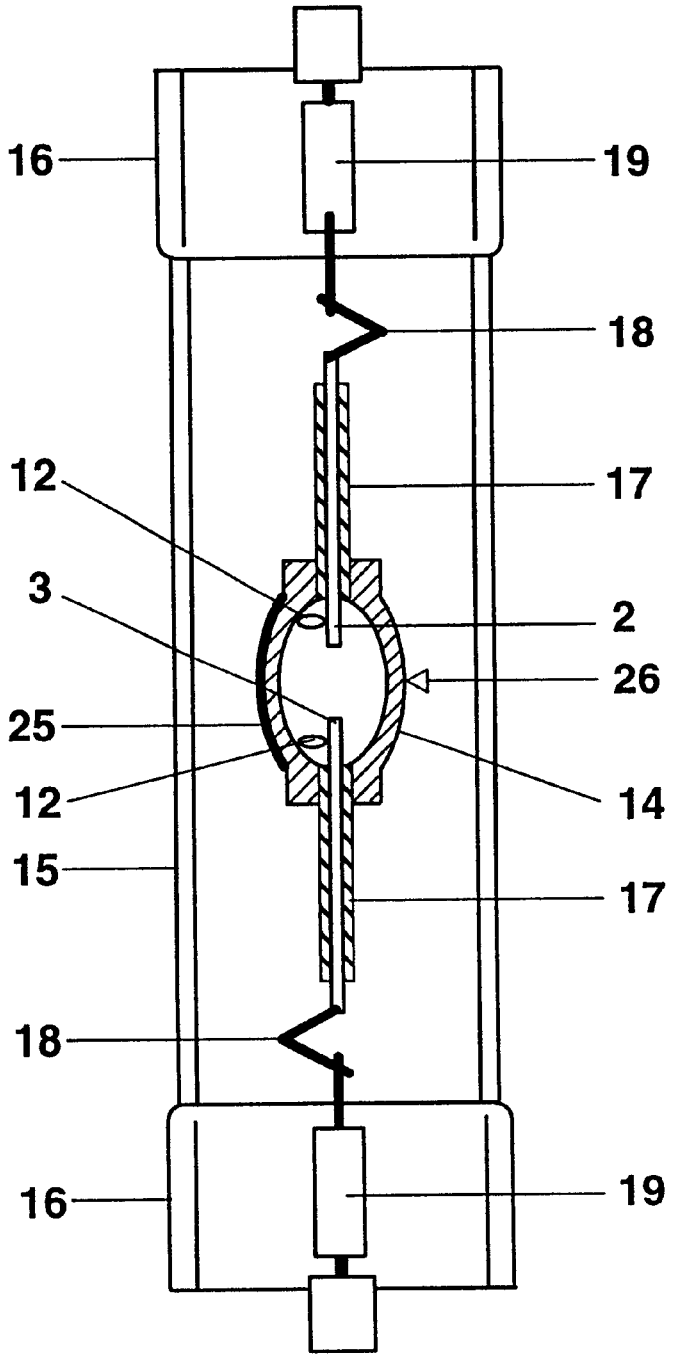

A metal halide lamp likewise capped at two ends is shown in FIG. 3. The discharge vessel 14 corresponds as far as possible to the exemplary embodiment represented in FIG. 2. The outer bulb 15 is again also sealed at two ends by pinches 16. Each of the lead-troughs 17 is connected directly to the molybdenum foil 19 in the pinch 16 via a short supply lead 18 in the form of an expansion loop.

In addition, a bent starting strip 25 extends here in an approximately axially parallel fashion as a conductor track over the belly 26 of the discharge vessel. The starting strip 25 ends in each case approximately at the level of the two electrodes 2, 3 and makes no contact with the supply leads 18. Consequently, it is coupled to the supply leads 18 only capacitively. The starting strip has a width of 0.1 mm. The starting pulse is applied to the first electrode 2 while the second electrode 3 is at zero potential.

What is claimed is:

1. A metal halide lamp having a ceramic, tubular discharge vessel (1) which defines a longitudinal axis and contains a filling and in which two electrodes (2, 3) are situated opposite one another, an electrically conducting starting aid being fitted outside on the discharge vessel (1), characterized in that the starting aid (11; 25) is constructed such that it produces an inhomogeneous electric field strength at least one electrode, in that the starting aid is at least punctiform around the cross-section of the vessel.

2. The metal halide lamp according to claim 1, characterized in that the starting aid (11) is also punctiform in axial direction in that the starting aid makes punctiform contact with the outer wall of the discharge vessel in the vicinity of a first electrode (2).

3. The metal halide lamp according to claim 2, characterized in that the starting aid (11) is connected at least temporarily in an electrically conducting fashion to a lead (8; 18*a*) which is connected to a second electrode (3).

4. Metal halide lamp according to claim 1, characterized in that the discharge vessel (24) is bellied (26) in the middle.

5. Metal halide lamp according to claim 4, characterized in that the starting aid is arcuately shaped by virtue of being fitted in an axially parallel fashion as a starting strip (25) on the belly (26), the starting strip (25) extending between the two electrodes (2, 3) on the outer wall of the discharge vessel.

6. Metal halide lamp according to claim 5, characterized in that the starting aid (25) is coupled to the electrodes (2, 3) in a purely capacitive fashion.

7. Metal halide lamp according to claim 1, characterized in that the filling contains at most 1 mg/cm$^3$ of mercury.

8. Metal halide lamp according to claim 1, characterized in that the material of the discharge vessel is free from yttrium and zirconium.

9. Metal halide lamp according to claim 1, characterized in that the filling contains a quantity of metal halides which is between 10 and 250 $\mu$mol/cm$^3$.

10. Metal halide lamp according to claim 1, characterized in that the starting aid is a wire or metal strip or a sintered-on starting strip.

* * * * *